US007302759B2

(12) United States Patent
Oh

(10) Patent No.: US 7,302,759 B2
(45) Date of Patent: Dec. 4, 2007

(54) HEAD-MOVING RAZOR

(76) Inventor: Tae-Jun Oh, Bupyrong6-ri, Jingeop-eup, Namyangju-shi, 472-864 (KR)

( * ) Notice: Subject to any disclaimer, the term of this patent is extended or adjusted under 35 U.S.C. 154(b) by 114 days.

(21) Appl. No.: 11/248,526

(22) Filed: Oct. 12, 2005

(65) Prior Publication Data

US 2006/0085984 A1 Apr. 27, 2006

(30) Foreign Application Priority Data

Oct. 12, 2004 (KR) ..... 20-2004-0028808

(51) Int. Cl.
*B26B 19/02* (2006.01)

(52) U.S. Cl. ..... 30/43.92; 30/346.51

(58) Field of Classification Search ..... 30/43.9, 30/43.92, 346.51, 527
See application file for complete search history.

(56) References Cited

U.S. PATENT DOCUMENTS

| | | | | |
|---|---|---|---|---|
| 4,796,359 | A * | 1/1989 | Oprach et al. | 30/43.92 |
| 4,930,217 | A * | 6/1990 | Wolf et al. | 30/43.92 |
| 5,163,227 | A * | 11/1992 | Wolf et al. | 30/43.92 |
| 5,557,850 | A * | 9/1996 | Mun | 30/43.92 |
| 6,205,666 | B1 * | 3/2001 | Junk | 30/43.92 |
| 6,381,849 | B2 * | 5/2002 | Eichhorn et al. | 30/43.92 |
| 6,789,322 | B2 * | 9/2004 | Iwashita et al. | 30/43.1 |
| 2002/0011003 | A1 * | 1/2002 | Van Hout et al. | 30/34.1 |
| 2002/0157257 | A1 * | 10/2002 | Oswald | 30/43.92 |

FOREIGN PATENT DOCUMENTS

| | | |
|---|---|---|
| JP | 55086490 | 12/1979 |
| JP | 62227395 | 3/1987 |
| JP | 63197484 | 11/1987 |
| JP | 10043443 A | 2/1998 |

* cited by examiner

*Primary Examiner*—Hwei-Siu C. Payer
(74) *Attorney, Agent, or Firm*—Cantor Colburn LLP

(57) ABSTRACT

Disclosed herein is a head-moving razor including a movable head part. The head-moving razor comprises a head cover having fitting parts and engaging parts, a double cutting blade disposed below the head cover and having insertion grooves, a supporting member having insertion bars, which are inserted into the insertion grooves, respectively, a moving member having engaging grooves, in which the engaging parts are engaged, respectively, the moving member also having through-holes and a bottom hole, a fixing member having protrusions, through-holes, and a bottom hole formed such that the moving member can be angularly moved back and forth about rotating pins, a vibrating member including a pair of vibrators while vibrating pins are attached to the vibrators, respectively, the vibrating member having inserting protrusions, and a drive motor having insertion holes, into which the inserting protrusions of the vibrating member are inserted, and rotors fitted on a motor shaft.

1 Claim, 4 Drawing Sheets

HEAD-MOVING RAZOR

BACKGROUND OF THE INVENTION

1. Field of the Invention

The present invention relates to a head-moving razor including a head part, which is angularly movable back and forth, and, more particularly, to a head-moving razor wherein a moving member is connected to a fixing member, which is fixed to a head part, by means of rotating pins, such that the moving member, in which a double cutting blade is mounted, can be angularly moved.

2. Description of the Related Art

There have been proposed a large number of electric reciprocating type razors, each of which includes a plurality of cutting blade heads movable freely relative to a body part, such that the plural cutting blade heads are brought into tight contact with the skin of a user, whereby a rapid and efficient shaving operation is accomplished.

One example of the conventional electric reciprocating type razors is disclosed in Japanese Unexamined Patent Publication No. S62-227395, wherein a rotary shaft is mounted in the vicinity of the upper end of a head block including a plurality of cutting blade heads, such that the head block can be angularly moved back and forth about the rotary shaft, whereby the cutting blade heads follow the skin of a user in every shaving direction. In the disclosed electric reciprocating type razor, however, the rotary shaft is disposed in the vicinity of the upper end of the head block, and therefore, the distance between the external blades, which are brought into contact with the skin, and the rotary shaft is small. As a result, if a pressing force is small when the external cutting blades are brought into contact with the skin while being inclined to the skin, the- angular movement of the head block is difficult. Furthermore, it is not possible to suspend the head blocks, i.e., it is not possible to push upward the head blocks such that the head blocks can be freely moved, and therefore, the head blocks can follow the contour of the skin only from side to side, and the head blocks cannot absorb impacts generated due to uneven bone parts when the shaving operation is performed. Consequently, the skin may be damaged, or smooth shaving operation may not be accomplished.

Another example of the conventional electric reciprocating type razors is disclosed in Japanese Unexamined Patent Publication No. S55-86490, wherein a plurality of cutting blade heads are independently suspended by means of springs, such that the cutting blade heads can be freely moved upward and downward, whereby the cutting blade heads follow the uneven skin through the vertical movement of the respective cutting blade heads while absorbing the impacts due to the unevenness of the skin. In the disclosed electric reciprocating type razor, however, it is required to set an initial load to the suspension force (the force by which the cutting blade heads are pushed upward by the respective springs) to more than a predetermined value in order to control the vibration of the entirety of the cutting blade heads due to the operation of the internal cutting blades. Consequently, if the pressing force, which is applied to the skin, is not considerably large, the cutting blade heads cannot properly follow the skin. Furthermore, when the external cutting blades are brought into contact with the skin while being inclined to the skin, the cutting blade heads cannot be brought into contact with the skin while the cutting blade heads are at a right angle to the skin. Consequently, the performance of the electric reciprocating type razor is not sufficiently accomplished.

Another example of the conventional electric reciprocating type razors is disclosed in Japanese Unexamined Patent Publication No. S63-197484, wherein a plurality of cutting blade heads are constructed to be freely moved, and adjacent cutting blade heads are coupled with each other by a ring, such that one of the coupled cutting blade heads is moved upward when the other of the coupled cutting blade heads is moved downward, whereby the cutting blade heads follow the unevenness of the skin. In the disclosed electric reciprocating type razor, however, it is not possible to absorb impacts generated when a shaving operation is performed. Furthermore, the cutting blade heads are not brought into contact with the skin while the cutting blade heads are at a right angle to the skin. Consequently, the performance of the electric reciprocating type razor is not sufficiently accomplished.

Still another example of the conventional electric reciprocating type razors is disclosed in Japanese Unexamined Patent Publication No. H10-43443, wherein cutting blade heads are integrally attached to a motor such that the cutting blade heads can be moved back and forth, from side to side, and upward and downward. In the disclosed electric reciprocating type razor, however, the supporting points provided to move the cutting blade heads are considerably low, and therefore, satisfactory following of the cutting blade heads to the skin is not accomplished.

SUMMARY OF THE INVENTION

Therefore, the present invention has been made in view of the above problems, and it is an object of the present invention to provide a reciprocating type head-moving razor including a movable head part, the structure of which is relatively simple and which can be brought into wide and smooth contact with the skin of a user, whereby a smooth and efficient shaving operation is accomplished.

It is another object of the present invention to provide a reciprocating type head-moving razor including a plurality of cutting blade heads, which can entirely follow unevenness of the skin and which can absorb impacts generated due to uneven bone parts.

In accordance with the present invention, the above and other objects can be accomplished by the provision of a head-moving razor comprising: a head cover having fitting parts and engaging parts formed at opposite sides thereof; a double cutting blade disposed below the head cover, the double cutting blade having insertion grooves formed at opposite sides thereof; a supporting member having insertion bars formed at opposite sides thereof such that the insertion bars can be inserted into the insertion grooves of the double cutting blade, respectively; a moving member having engaging grooves formed at the inner lower ends of opposite sides thereof such that the engaging parts of the head cover can be engaged in the engaging grooves, respectively, the moving member also having through-holes at the upper ends of the opposite sides thereof and a bottom hole formed at the bottom part thereof; a fixing member having protrusions formed at the outer surfaces of opposite sides thereof, through-holes at the upper ends of the opposite sides thereof, and a bottom hole formed at the bottom part thereof, such that the moving member can be angularly moved back and forth about rotating pins; a vibrating member including a pair of vibrators disposed at opposite sides of the upper part thereof while vibrating pins are attached to the vibrators, respectively, the vibrating member having inserting protrusions formed at the inside thereof; and a drive motor having insertion holes formed at the upper end thereof such that the inserting protrusions of the vibrating member can be inserted into the insertion holes, the drive motor also having a plurality of rotors fitted on a motor shaft.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be described in detail with reference to the accompanying drawings.

Figure 1:
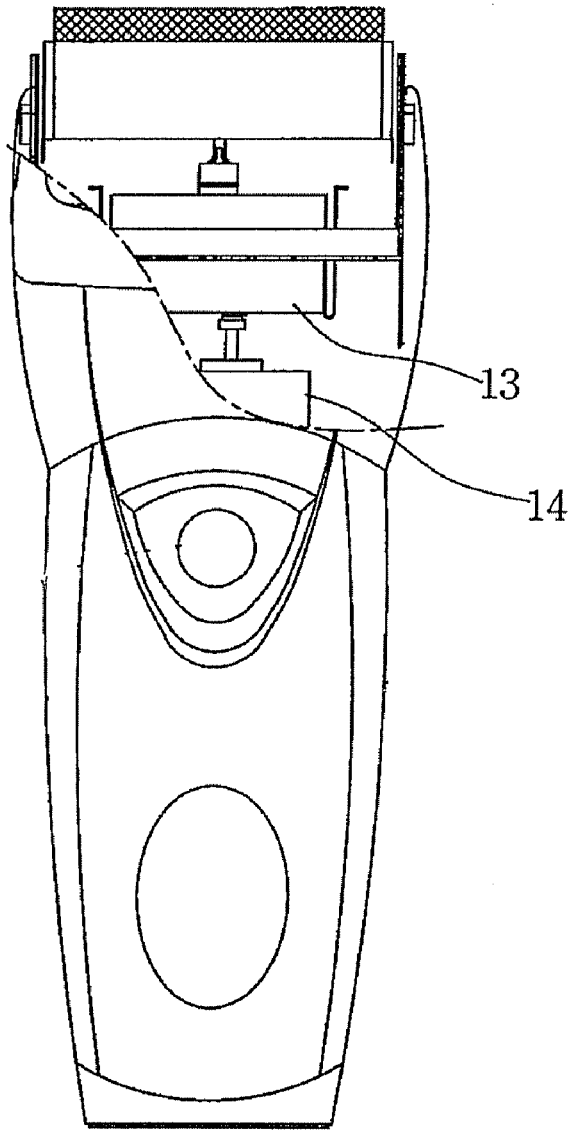
FIG. 1 is a front view, partially in section, of a head-moving razor according to the present invention, schematically illustrating the structure of a head part of the head-moving razor.
Figure 2:
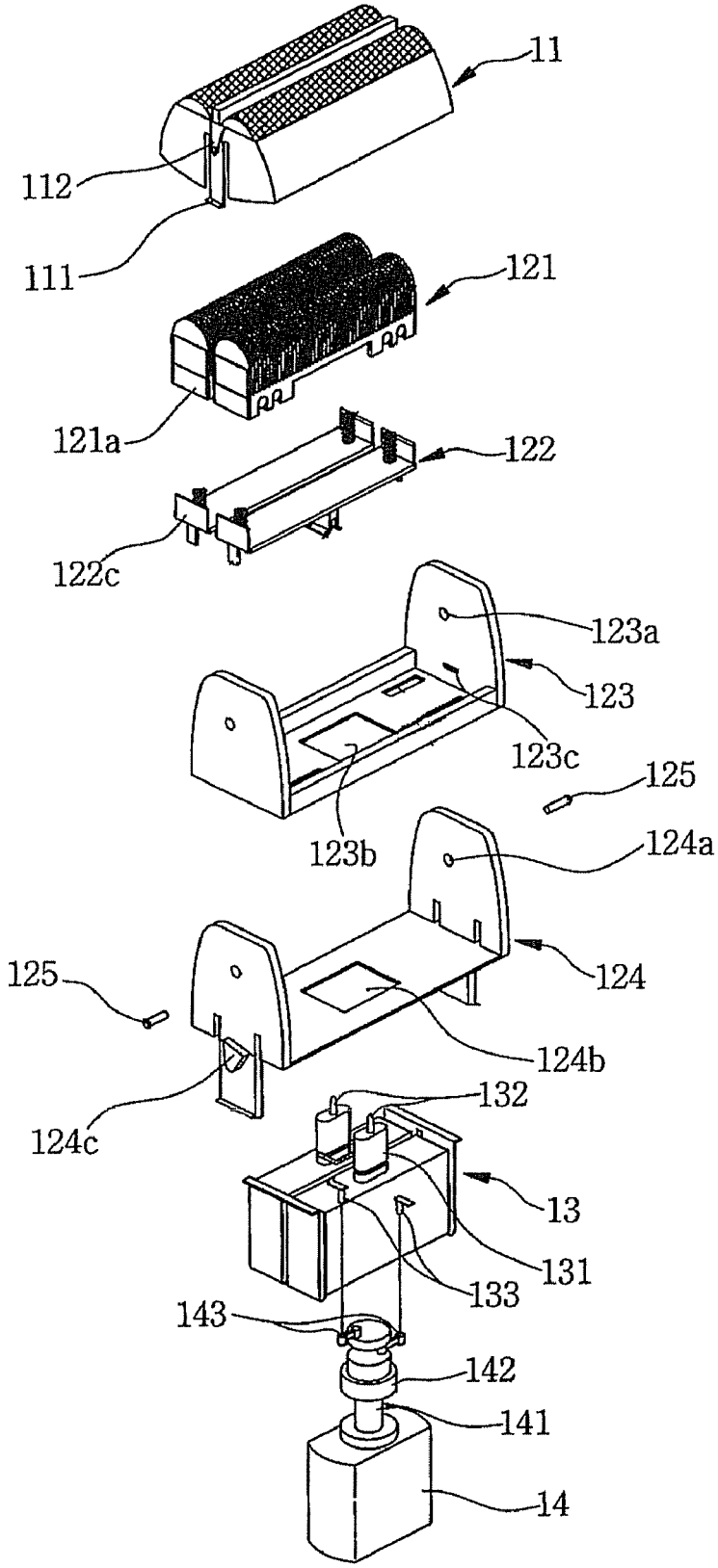
FIG. 2 is an exploded perspective view illustrating the head-moving razor according to the present invention.
Figure 3:
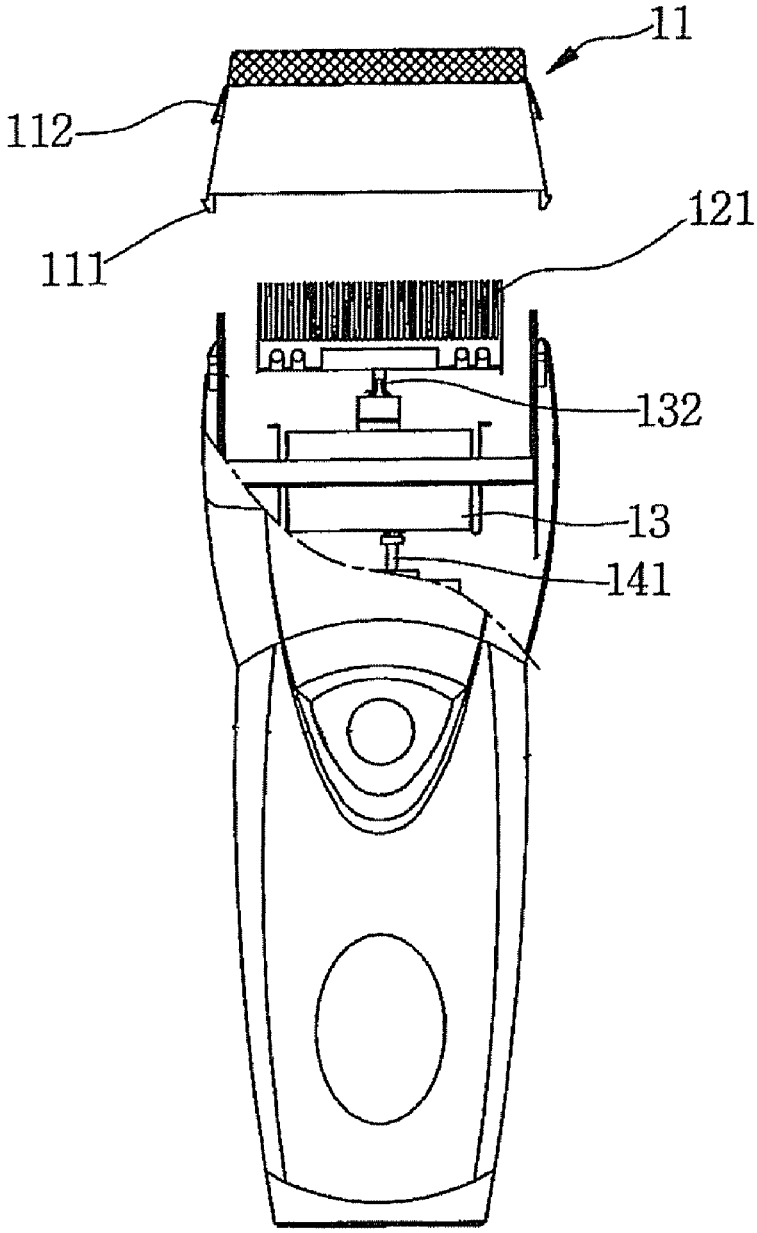
FIG. 3 is a front view, partially in section, of the head-moving razor according to the present invention, schematically illustrating the structure of the head part of the head-moving razor when a head cover is separated from the head part.
Figure 4:
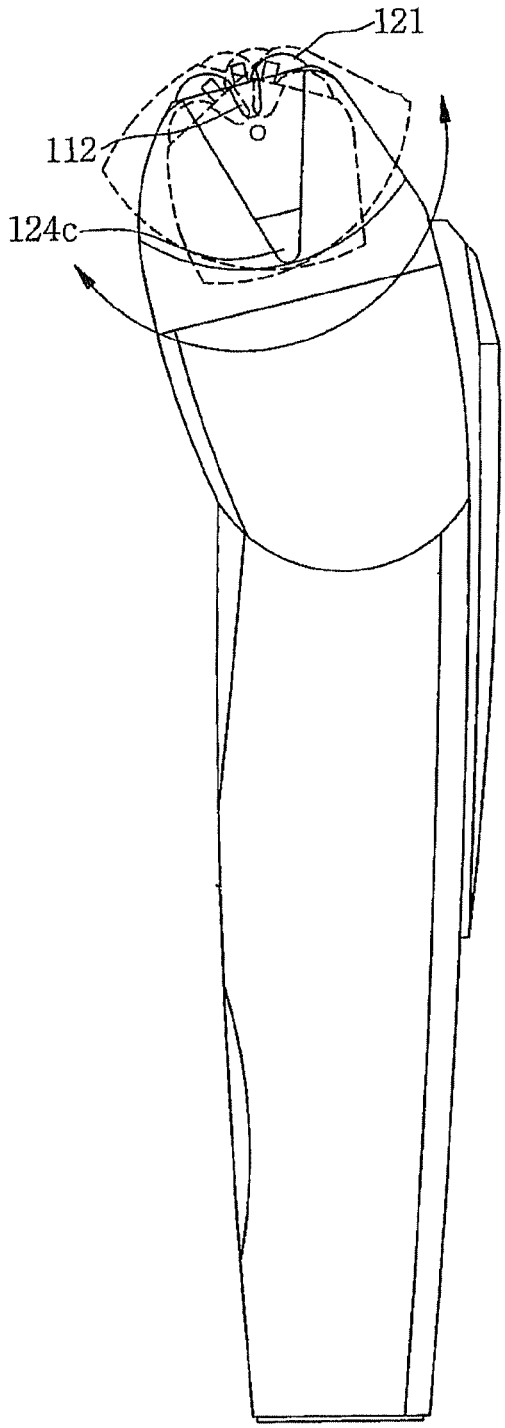
FIG. 4 is a side view illustrating the angular movement of the head part of the head-moving razor according to the present invention.

FIG. 1 is a front view, partially in section, of a head-moving razor according to the present invention, schematically illustrating the structure of a head part of the head-moving razor, FIG. 2 is an exploded perspective view illustrating the head-moving razor according to the present invention, FIG. 3 is a front view, partially in section, of the head-moving razor according to the present invention, schematically illustrating the structure of the head part of the head-moving razor when a head cover is separated from the head part, and FIG. 4 is a side view illustrating the angular movement of the head part of the head-moving razor according to the present invention.

Referring to FIGS. 1 and 4, the head-moving razor according to the present invention comprises: a head cover 11 having fitting parts 112 and engaging parts 111 formed at opposite sides thereof; a double cutting blade 121 disposed below the head cover 11, the double cutting blade 121 having insertion grooves 121*a* formed at opposite sides thereof; a supporting member 122 having insertion bars 122*c* formed at opposite sides thereof such that the insertion bars 122*c* can be inserted into the insertion grooves 121*a* of the double cutting blade 121, respectively; and a moving member 123 having engaging grooves 123*c* formed at the inner lower ends of opposite sides thereof such that the engaging parts 111 of the head cover 11 can be engaged in the engaging grooves 123*c*, respectively, the moving member 123 also having through-holes 123*a* at the upper ends of the opposite sides thereof and a bottom hole 123*b* formed at the bottom part thereof.

The head-moving razor according to the present invention further comprises: a fixing member 124 having protrusions 124*c* formed at the outer surfaces of opposite sides thereof, through-holes 124*a* at the upper ends of the opposite sides thereof, and a bottom hole 124*b* formed at the bottom part thereof, such that the moving member 123 can be angularly moved back and forth about rotating pins 125; a vibrating member 13 including a pair of vibrators 131 disposed at opposite sides of the upper part thereof while vibrating pins 132 are attached to the vibrators 131, respectively, the vibrating member 13 having inserting protrusions 133 formed at the inside thereof and a drive motor 14 having insertion holes 143 formed at the upper end thereof such that the inserting protrusions 133 of the vibrating member 13 can be inserted into the insertion holes 143. In an exemplary embodiment, the drive motor 14 may have a plurality of rotors 142 fitted on a motor shaft 141, or a single rotor 142 fitted on the motor shaft 141 as illustrated in FIG.2.

Specifically, the rotating pins 125 are inserted through the through holes 124*a* formed at the opposite sides of the fixing member 124 and the through-holes 123*a* formed at the opposite sides of the moving member 123, which is mounted inside the fixing member 124. As a result, the moving member 123, to which the double cutting blade 121 is attached, can be angularly moved back and forth.

As apparent from the above description, the moving member, to which the double cutting blade is attached, is connected to the fixing member, which is fixed to the head part, by means of the rotating pins, such that the moving member can be angularly moved back and forth. Consequently, the present invention has the effect of enabling a smooth shaving operation of the reciprocating type head-moving razor and improving the cutting efficiency of the reciprocating type head-moving razor.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A head-moving razor comprising:

a head cover having fitting parts and engaging parts formed at opposite sides thereof;

a double cutting blade disposed below the head cover, the double cutting blade having insertion grooves formed at opposite sides thereof;

a supporting member having insertion bars formed at opposite sides thereof such that the insertion bars can be inserted into the insertion grooves of the double cutting blade, respectively;

a moving member having engaging grooves formed at the inner lower ends of opposite sides thereof such that the engaging parts of the head cover can be engaged in the engaging grooves, respectively, the moving member also having through-holes at the upper ends of the opposite sides thereof and a bottom hole formed at the bottom part thereof;

a fixing member having protrusions formed at the outer surfaces of opposite sides thereof, through-holes at the upper ends of the opposite sides thereof, a bottom hole formed at the bottom part thereof, and rotating pins extending through the through holes of the moving member and the through holes of the fixing member, such that the moving member can be angularly moved back and forth about the rotating pins;

a vibrating member including a pair of vibrators disposed at opposite sides of the upper part thereof while vibrating pins are attached to the vibrators, respectively, the vibrating member having inserting protrusions formed at the inside thereof; and a drive motor having insertion holes formed at the upper end thereof such that the inserting protrusions of the vibrating member can be inserted into the insertion holes, the drive motor also having a plurality of rotors fitted on a motor shaft.

* * * * *